United States Patent [19]

McVey

[11] Patent Number: 4,464,603

[45] Date of Patent: Aug. 7, 1984

[54] CERAMIC SEAL FOR HIGH PRESSURE SODIUM VAPOR LAMPS

[75] Inventor: Charles I. McVey, Shaker Heights, Ohio

[73] Assignee: General Electric Company, Schenectady, N.Y.

[21] Appl. No.: 401,763

[22] Filed: Jul. 26, 1982

[51] Int. Cl.[3] ..... H01J 61/36

[52] U.S. Cl. ..... 313/624; 313/623

[58] Field of Search ..... 313/623, 624, 625

[56] References Cited

U.S. PATENT DOCUMENTS

| | | | |
|---|---|---|---|
| 3,832,588 | 8/1974 | McVey et al. | 313/624 |
| 4,034,252 | 7/1977 | McVey | 313/625 |
| 4,065,691 | 12/1977 | McVey | 313/565 |
| 4,160,186 | 7/1979 | Kerekes | 313/623 X |

FOREIGN PATENT DOCUMENTS

| | | | |
|---|---|---|---|
| 53-108682 | 9/1978 | Japan | 313/625 |
| 55-24328 | 2/1980 | Japan | 313/624 |

*Primary Examiner*—David K. Moore
*Assistant Examiner*—Vincent DeLuca
*Attorney, Agent, or Firm*—John F. McDevitt; Philip L. Schlamp; Fred Jacob

[57] ABSTRACT

An improved end closure for a tubular light-transmitting ceramic envelope used in sodium vapor lamps is disclosed which comprises assembly of a ceramic disc fitted into one end of a metal sleeve having a different diameter opening at its opposite end for circumferential engagement with the arc tube inserted therein with all of the assembled members being hermetically sealed together by a ceramic sealing frit. The improved end closure permits thermionic electrodes to be inserted through openings in the ceramic discs with said electrodes being hermetically sealed at said openings with additional ceramic sealing frit.

6 Claims, 3 Drawing Figures

CERAMIC SEAL FOR HIGH PRESSURE SODIUM VAPOR LAMPS

BACKGROUND OF THE INVENTION

Various type ceramic closures are already known to close each end of the tubular light-transmitting ceramic envelope used for sodium vapor lamps such as described in U.S. Pat. Nos. 4,034,252 and 4,065,691, both assigned to the assignee of the present invention. In said earlier issued patent, the end of said arc tube is closed with a ceramic plug that is inserted into the arc tube end and which has a central aperture to permit passage of an electrode inlead therethrough, with all of said members being hermetically sealed together by sealing frit. A metal reflector band is also mentioned in said patent for placement at the upper end of said arc tube in order to help maintain the desired temperature of lamp operation. The sealing frit is said to comprise primarily aluminum oxide and calcium oxide and which is heated to provide a molten glass during the sealing operation. In the subsequently issued aforementioned patent, the end closure is provided by a ceramic plug inserted into the end of the arc tube and which again permits passage of an electrode inlead wire therethrough, and with a hermetic seal being affected between all of said joined closure members. A metal reflector band is also mentioned in said patent for the same utilization above described.

Difficulties are still being experienced with the known end closures in providing reliable hermetic seals between the metal and ceramic lamp components being joined. For example, sealing the ceramic plug to the ceramic arc tube has proven difficult with success generally requiring careful control of both disc and tube dimension along with precise attention being given to the amount of sealing frit used. Too little sealing frit produces incomplete filling of the surfaces being joined and with leakage occurring at such locations. Too much frit produces large sealing fillets that can cause cracking of the ceramic tubing material due to any slight mismatch in thermal expansion between the sealing frit and the ceramic tubing. Additionally, the insertion of a ceramic plug into the end of the arc tube requires an increase in tubing length to maintain the same inner volume of the arc tube. Such construction not only increases cost of the lamp being manufactured but has further required the aforementioned head reflector means in order to preserve the same lamp operating conditions. It may be desirable, therefore, to improve the end closure for this type lamp without undue modification or additional cost in either the lamp manufacture or subsequent lamp operation.

SUMMARY OF THE INVENTION

A novel end closure for said arc tube has now been discovered which does not require that a plug member be inserted into the arc tube or that special processing steps be utilized in order to achieve a reliable hermetic seal. Specifically, the presently improved end closure utilizes an assembly of associated metal and ceramic components that includes a ceramic disc having a larger diameter than the internal diameter of said arc tube and butt-seals said disc directly to the end of the arc tube with conventional ceramic sealing frit. Such sealing arrangement avoids any need to add length to the arc tube for compensation of a plug insert or control the dimensions between these components parts. In the present end closure, there is further utilized a metal sleeve that couples the end of said arc tube to said ceramic disc and with the assembled being hermetically sealed together with the ceramic sealing frit. Said metal sleeve includes different size openings to accommodate the arc tube and ceramic discs being joined together by the bonding action of said ceramic sealing frit to form the desired hermetic seal. Additionally, the ceramic disc further includes a central opening for passage of a thermionic electrode inlead therethrough and with a hermetic seal being achieved at said opening with additional ceramic sealing frit. A still further advantage is gained when the component parts of the present end closure are sealed together in this manner. As distinct from the aforementioned prior art end closures where washers or rings of sealing frit are generally utilized in effecting the desired hermetic seal, it is now possible to achieve the same result in the present end closure by simply using a liquid slurry of the frit material.

One preferred embodiment of the present end closure utilizes a ceramic disc having a larger diameter than the external diameter of the arc tube and which is inserted into one end of the metal sleeve for butt-sealing to the end of said arc tube. A smaller diameter opening at the opposite end of said metal sleeve permits circumferential engagement with the end of the arc tube when these parts are assembled together for hermetic sealing with ceramic sealing frit. A central opening in the ceramic disc permits passage therethrough of a conventional exhaust tube member that further serves as an inlead for sodium vapor lamps. A hermetic seal is effected between said opening and the exhaust tube in the same manner used for hermetic sealing of the previously mentioned structural components in said closure embodiment.

A different preferred embodiment of the present end closure utilizes a ceramic disc having a diameter intermediate between the internal and external diameters of the arc tube. For said embodiment, the ceramic disc will be fitted into the smaller diameter opening of the associated metal sleeve which now has a larger diameter opening at its opposite end for circumferential engagement with the end of the arc tube and subsequent butt-seal joinder between the arc tube and ceramic disc. The ceramic disc further includes a central opening for passage therethrough of an electrode inlead wire as is customary for one of the electrode structures in conventional sodium vapor lamps. Hermetic sealing of all assembled members in said closure embodiment can take place in the same manner as above described for the preceding embodiment.

A representative high pressure sodium vapor lamp containing the presently improved end closure for operation at a given power input of about 400 watts and at a given lamp voltage drop of about 100 volts thereby comprises:

(a) a tubular light-transmitting alumina ceramic arc tube having thermionic electrodes sealed into its ends by ceramic closures and a charge of sodium mercury amalgam in excess of the quantity vaporized in normal operation along with a xenon gas fill to facilitate starting; and (b) an evacuated outer light transmitting vitreous envelope surrounding said arc tube having a stem press seal at one end through which extends a pair of inleads electrically connected to said thermionic electrodes;

(c) said ceramic closures each comprising an assembly of a ceramic disc having a larger diameter than the internal diameter of said alumina arc tube and which is inserted into one end of a metal sleeve having a different diameter at its opposite end for circumferential engagement with said alumina arc tube and with the assembled members being hermetically sealed together by a ceramic sealing frit, said electrodes being inserted through openings in the ceramic discs and being hermetically sealed at said openings with a ceramic sealing frit.

As previously indicated, one of said ceramic closures can provide the means for passage of a first thermionic electrode that includes a metal exhaust tube and with the remaining ceramic closure located at the opposite end of the arc tube serving to introduce a wire inlead for the second thermionic electrode.

DETAILED DESCRIPTION OF THE PREFERRED EMBODIMENTS

Figure 1:
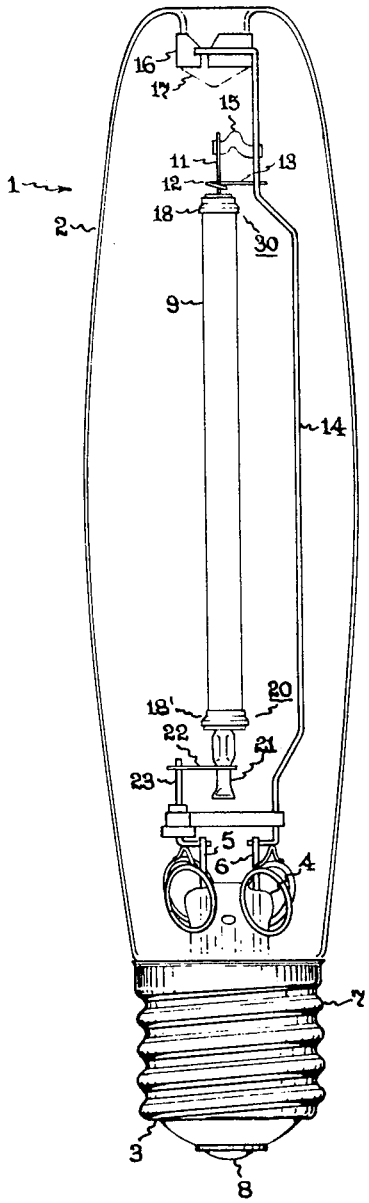
FIG. 1 shows a high pressure sodium vapor lamp embodying the presently improved ceramic closure structure.

Referring to FIG. 1, a high pressure sodium vapor lamp 1 corresponding to a 400-watt size is illustrated which comprises vitreous outer envelope 2 having a standard mogul screw base 3 attached to one end and comprising a reentrant stem press seal 4 through which extend, in conventional fashion, a pair of relatively heavy lead-in conductors 5 and 6 whose outer ends are connected to the screw shell 7 and eyelet 8 of the base. The inner envelope or arc tube 9 centrally located within said outer envelope comprises a length of light-transmitting ceramic tubing, preferably polycrystalline alumina ceramic which is translucent or which can be single crystal alumina which is clear and transparent. The upper end of the arc tube is closed by a closure structure in accordance with the present invention through which extends a niobium inlead wire 11 hermetically sealed. The inlead supports the upper electrode which may be generally similar to the lower electrode and with both of said electrodes being more specifically illustrated in the following FIGS. 2–3 embodiments. The external portion of inlead 11 passes through a loop 12 in transverse support wire 13 attached to a side rod 14. This arrangement allows for thermal expansion of the arc tube during lamp operation when the lower end seal is rigidly fixed in place, and a resilient metal ribbon 15 assures continued good electrical connection. Side rod 14 is welded to lead-in conductor 6 and has its upper end braced by spring clamp 16 which engages inverted nipple 17 in the dome end of the outer vitreous envelope. The metal sleeves 18 and 18' which form part of the end closures at each end of arc tube 9 serve to maintain the desired lamp operating temperature particularly in smaller sizes of lamps such as 250 watts or less. The lower end closure and electrode support assembly 20 for said lamp has a central aperture through which extends a thin-walled niobium tube 21 serving as an exhaust tube and as an inlead. Said tube extends but a short distance through the end closure and is hermetically sealed therethrough by sealing frit as will be explained in the further descriptions given in FIGS. 2–3 dealing with both of the end closure embodiments. The closed arc tube is supported in the outer envelope by a connector 22 which is welded across from tubular inlet 21 to a support rod 23 joined to lead-in conductor 5.

Figure 2:
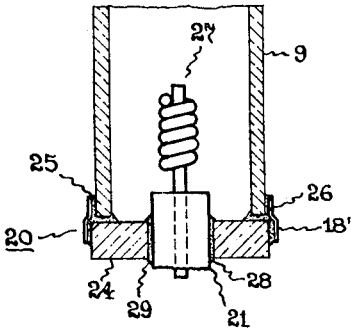
FIG. 2 is an enlarged detailed view of one electrode employed in the FIG. 1 lamp embodiment.

The present invention resides in the ceramic closure itself which is depicted in greater detail for the lower electrode structure and the electrode support assembly therefor as shown in FIG. 2. Specifically, said improved ceramic closure 20 comprises an assembly of a ceramic disc 24 having a larger diameter than the internal diameter of said arc tube 9 and which is inserted into one end of metal sleeve 18' to effect a physical coupling with the end of said arc tube being held in a smaller diameter opening 25 at the opposite end of said metal sleeve. A hermetic seal is formed at the butt-sealed interface between said joined parts by the bonding action of a conventional sealing frit 26. As can be noted, the resulting seal engagement includes bonding of the ceramic frit to the inner wall of the metal sleeve. A conventional electrode 27 is also shown to include part of the associated metal exhaust tube 21 which is hermetically sealed to form part of the assembled end closure. Said exhaust tube component is inserted through a central opening 28 and with the hermetic seal again being formed at the innerface surfaces with additional sealing frit 29. As previously indicated, all hermetic sealing in the present closure structure can be formed with a liquid slurry of suspended frit particles being applied at the interface surfaces for subsequent sintering to produce the customary vitreous bonding action. Bonding strength to the metal sleeve can be promoted by coating the metal member with various metallic agents such as tungsten oxide, chromium oxide, molybdenum oxide, or metal plating the surface with reactive metals such as zirconium, vanadium, titanium, yttrium, or combinations thereof.

Figure 3:
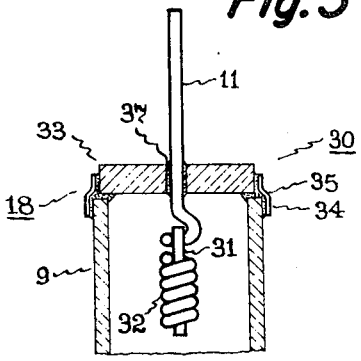
FIG. 3 is an enlarged detailed view of the remaining electrode employed in said FIG. 1 lamp embodiment.

The upper electrode structure and electrode support assembly 30 according to the present invention is depicted in FIG. 3. Specifically, inlead 11 is joined to a tungsten shank 31 of a conventional electrode 32 having one or more refractory metal coils wound thereon and with said electrode support assembly being hermetically sealed in the ceramic closure of the present invention. Said closure embodiment 30 comprises the assembly of a ceramic disc member 33 having a diameter intermediate between the internal and external diameters of said arc tube 9 and which has been inserted into one end of metal sleeve 18 for the butt-seal engagement with one end above said arc tube. In this particular closure structure, the larger diameter opening 34 of the metal sleeve circumferentially engages the end of the arc tube. As will the preceding closure embodiment, however, the hermetic sealing between said metal sleeve, the ceramic disc, and the arc tube with sealing frit 35 remains the same. Similarly, hermetic sealing of the inlead 11 at central opening 36 in the ceramic disc with additional sealing frit 37 can also be carried out in the same manner described for said preceding embodiment.

It will be apparent from the foregoing description that an improved ceramic closure for high pressure sodium vapor type lamps has been disclosed which is generally useful. It will be further apparent to those skilled in the lamp art, however, that said improved ceramic closure can replace conventional end closures in this type lamp although remaining features in the lamp other than above specifically disclosed are employed. For example, lamp designs utilizing additional gettering and starting aides can use the present arc tube and ceramic closure configuration herein described. Accordingly, it is intended to limit the present invention only by the scope of the following claims.

What I claim as new and desire to secure by U.S. Letters Patent is:

1. An improved high pressure sodium vapor lamp having a tubular light-transmitting ceramic envelope with thermionic electrodes being sealed into its ends by ceramic closures, the improvement wherein said ceramic closures comprise and assembly of a ceramic disc having a larger diameter than the internal diameter of said tubular light-transmitting envelope and which is inserted into one end of a metal sleeve having a different diameter opening at its opposite end for circumferential engagement with said tubular light-transmitting envelope, and with the assembled members being hermetically sealed together by a ceramic sealing frit which directly bonds the ceramic disc to the metal sleeve.

2. An improved lamp as in claim 1 wherein the ceramic closure is used at each end of said tubular light-transmitting envelope.

3. An improved lamp as in claim 1 wherein the thermionic electrodes are both inserted through openings in the ceramic discs and hermetically sealed at said openings with a ceramic sealing frit.

4. An improved lamp as in claim 1 wherein the thermionic electrodes comprise refractory metal wire coils wound around a tungsten shank.

5. An improved high pressure sodium vapor lamp comprising:

(a) a tubular light-transmitting alumina ceramic arc tube having thermionic electrodes sealed into each end by ceramic closures and a charge of sodium-mercury amalgam in excess of the quantity vaporized in normal operation along with xenon gas to facilitate starting; and (b) an evacuated outer light-transmitting vitreous envelope surrounding said arc tube having a stem press seal at one end through which extends a pair of inleads electrically connected to said thermionic electrodes;

(c) said ceramic closures each comprising an assembly of a ceramic disc having a larger diameter than the internal diameter of said alumina ceramic tube and which is inserted into one end of a metal sleeve having a different diameter opening at its opposite end for circumferential engagement with said alumina ceramic tube and with the assembled members being hermetically sealed together by a ceramic sealing frit, said electrodes being inserted through openings in the ceramic discs and being hermetically sealed at said openings with a ceramic sealing frit and with said ceramic discs being bonded directly to the metal sleeves with said ceramic sealing frit.

6. An improved lamp as in claim 5 wherein the thermionic electrodes comprise refractory metal wire coils wound around a tungsten shank.

* * * * *